US006834625B2

(12) United States Patent
Matsutani et al.

(10) Patent No.: US 6,834,625 B2
(45) Date of Patent: Dec. 28, 2004

(54) COOLING APPARATUS OF AN INTERNAL COMBUSTION ENGINE

(75) Inventors: Takashi Matsutani, Toyota (JP); Yoshikazu Shinpo, Nissin (JP); Takanori Nakada, Toyota (JP); Yasuki Hashimoto, Okazaki (JP); Makoto Hatano, Obu (JP); Katsunori Ueda, Toyota (JP)

(73) Assignees: Toyota Jidosha Kabushiki Kaisha, Toyota (JP); Aisan Kogyo Kabushiki Kaisha, Obu (JP); Nichias Corporation, Tokyo (JP)

( * ) Notice: Subject to any disclaimer, the term of this patent is extended or adjusted under 35 U.S.C. 154(b) by 0 days.

(21) Appl. No.: 10/452,117

(22) Filed: Jun. 3, 2003

(65) Prior Publication Data

US 2003/0230254 A1 Dec. 18, 2003

(30) Foreign Application Priority Data

Jun. 12, 2002 (JP) ..... 2002-171917

(51) Int. Cl.[7] ..... F02F 1/14
(52) U.S. Cl. ..... 123/41.79; 123/41.72
(58) Field of Search ..... 123/41.79, 41.72, 123/41.74, 41.57, 41.67, 41.15

(56) References Cited

U.S. PATENT DOCUMENTS 4,253,431 A 3/1981 Mettig et al.
6,581,550 B2 * 6/2003 Shinpo et al. ..... 123/41.74

FOREIGN PATENT DOCUMENTS

| | | |
|---|---|---|
| DE | 24 33 813 | 6/1975 |
| DE | 40 29 427 A1 | 4/1991 |
| DE | 101 02 644 C1 | 2/2002 |
| GB | 1012082 | 12/1965 |
| JP | 57-43338 | 12/1982 |
| JP | A 63-272950 | 11/1988 |
| JP | A8-296495 | 11/1996 |
| JP | A-9-88713 | 3/1997 |

OTHER PUBLICATIONS

U.S. Appl. No. 09/891,402, filed Jun. 27, 2001, Shinpo et al.

* cited by examiner

*Primary Examiner*—Mahmoud Gimie
*Assistant Examiner*—Katrina Harris
(74) *Attorney, Agent, or Firm*—Oliff & Berridge PLC

(57) ABSTRACT

A cooling apparatus of an internal combustion engine includes a closed deck-type cylinder block and an insert. The cylinder block includes a water jacket and an upper deck including a water hole formed therein. The insert is disposed in the water jacket and inserted into the water jacket through the water hole. The insert is fixed relative to the cylinder block at a water hole portion such that the insert is fixed in position in a flow direction of the cooling water. A stopper for preventing the insert from moving downstream in a flow direction of the cooling water may be formed, and the insert engages the stopper such that the insert is fixed in position in the flow direction of the cooling water.

7 Claims, 5 Drawing Sheets

COOLING APPARATUS OF AN INTERNAL COMBUSTION ENGINE

BACKGROUND OF THE INVENTION

1. Field of Invention

The present invention relates to a cooling apparatus of an internal combustion engine including an insert inserted into a water jacket of a cylinder block of the engine, and more particularly, relates to a structure for fixing the insert to the cylinder block.

2. Description of Related Art

In an internal combustion engine, a water jacket is formed around cylinder bores in a cylinder block, and engine cooling water is caused to flow in the water jacket to cool the engine which is heated due to combustion and sliding of a piston. A temperature of a cylinder bore wall is likely to be higher at an upper portion of the cylinder bore wall than at a lower portion of the cylinder bore wall. Therefore, if the cooling water is caused to flow uniformly at an upper portion and a lower portion of the water jacket for preventing the temperature of the upper portion of the cylinder bore wall from being too high, the lower portion of the cylinder bore will be over-cooled, resulting in an increase in a friction loss generated in the sliding of the piston with the cylinder bore.

In order to improve a temperature distribution in the cylinder bore wall, Japanese Utility Model Publication SHO 57-43338 discloses that an insert is disposed in a water jacket. By providing the insert in the water jacket, a heat removed from the cylinder bore wall can be controlled. More particularly, at a portion where the insert is provided, a flow amount is decreased and the temperature of the cylinder bore wall is maintained high (i.e., less of a cooling effect takes place). By the heat control, the temperature distribution of the cylinder bore wall is improved.

In a closed deck-type cylinder block, the insert can be inserted into and mounted in the water jacket through a water hole formed in an upper deck of the cylinder block.

In the engine having the insert in the water jacket, if the insert is not fixed relative to the cylinder block properly, the insert may be moved and dislocated from a normal position when receiving a pressure from the cooling water. If dislocated, the insert cannot perform a normal temperature control and may block the water hole.

SUMMARY OF THE INVENTION

An object of the invention is to provide a cooling apparatus of an internal combustion engine capable of preventing an insert disposed in a water jacket from being dislocated from a normal position.

The above object can be performed by the following cooling apparatus of an internal combustion engine according to aspects of the present invention.

A cooling apparatus of an internal combustion engine according to one aspect of the invention includes a closed deck-type cylinder block and an insert. The closed deck-type cylinder block has a water jacket for causing engine cooling water to flow therein to cool the engine, and an upper deck including a water hole formed therein for causing the cooling water flow therethrough and a water hole portion surrounding the water hole. The insert is disposed in the water jacket and is inserted into the water jacket through the water hole. The insert is fixed relative to the cylinder block at the water hole portion such that the insert is fixed in position in a flow direction of the cooling water.

According to one embodiment, the insert includes a spring mechanism formed therein for fixing the insert to the cylinder block by a reaction force of the spring mechanism. This avoids a specialized machining of the cylinder block.

According to one embodiment, a pad is provided in a clearance between the water hole portion and the insert, for fixing the insert to the cylinder block. This also avoids a specialized machining of the cylinder block.

According to one embodiment, a clip is provided that engages with the water hole portion and the insert so as to fix the insert to the cylinder block.

According to one embodiment, the cylinder block includes a groove formed in the water hole portion of the upper deck, and the insert has a key formed therein and fitted in the groove so as to fix the insert to the cylinder block.

A cooling apparatus of an internal combustion engine according to another aspect of the invention includes a closed deck-type cylinder block and an insert, wherein the closed deck-type cylinder block has a water jacket for causing engine cooling water to flow therein to cool the engine and a water jacket wall surrounding the water jacket, and an upper deck including a water hole formed therein for causing the cooling water to flow therethrough. The insert is disposed in the water jacket and is inserted into the water jacket through the water hole. A stopper for preventing the insert from moving downstream in a flow direction of the cooling water is formed to the water jacket wall, and the insert engages the stopper such that the insert is fixed in position in the flow direction of the cooling water.

According to one embodiment, the stopper is a protrusion formed in at least one of a bottom wall portion and an outer side wall portion of the water jacket wall.

According to one embodiment, the stopper is an extension extending from a cylinder head mounted to the cylinder block into the water jacket.

According to one embodiment, the stopper is an extension extending from a cylinder head gasket mounted to the cylinder block into the water jacket.

According to one embodiment, the stopper is a protrusion protruding from a tight plug mounted to the cylinder block into the water jacket.

According to one embodiment, the stopper is a chaplet used in the manufacture of the cylinder block, and which remains in the water jacket.

A cooling apparatus of an internal combustion engine according to one aspect of the invention includes a closed deck-type cylinder block and an insert, wherein the closed deck-type cylinder block has a water jacket for causing engine cooling water to flow therein to cool the engine, and an upper deck including a water hole formed therein for causing the cooling water to flow therethrough. The insert is disposed in the water jacket and is inserted into the water jacket through the water hole. The insert includes an upstream portion having a streamline configuration.

By fixing the insert relative to the cylinder block at the water hole portion, the insert is prevented from being dislocated from its normal position when receiving a pressure from the cooling water, while feasibility of mounting the insert into the water jacket is maintained.

By causing the insert to contact the stopper formed to the water jacket wall, the insert is prevented from being dislocated from its normal position when receiving a pressure from the cooling water, while feasibility of mounting the insert into the water jacket is maintained.

By forming the insert to have an upstream portion having a streamline configuration, the pressure acting on the insert from the cooling water is minimized. As a result, the insert is prevented from being dislocated from its normal position.

BRIEF DESCRIPTION OF THE DRAWINGS

The above and other objects, features, and advantages of the present invention will become apparent and will be more readily appreciated from the following detailed description of preferred exemplary embodiments of the present invention in conjunction with the accompanying drawings, in which.

DETAILED DESCRIPTION OF PREFERRED EMBODIMENTS

Figure 1A:
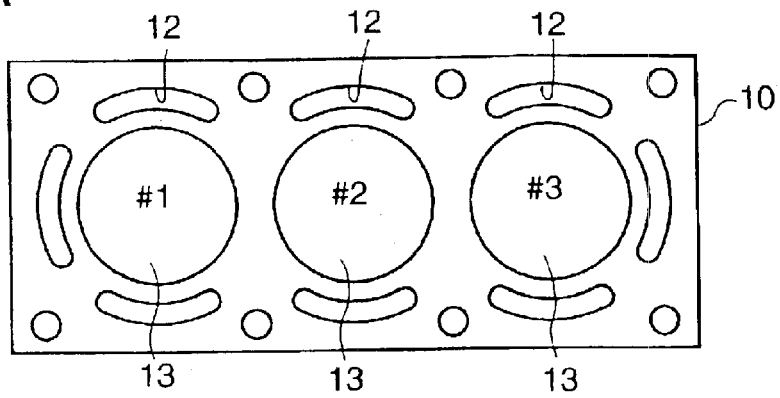
FIG. 1A is a plan view of a cylinder block to which a cooling apparatus of an internal combustion engine according to a first embodiment of the present invention is applied.
Figure 1B:
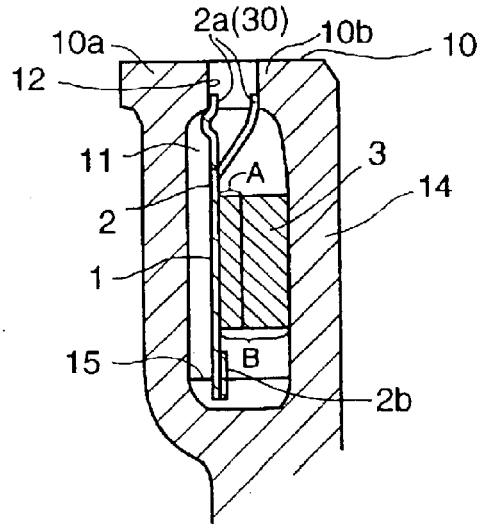
FIG. 1B is a transverse cross-sectional view of the cooling apparatus of an internal combustion engine according to the first embodiment of the present invention.
Figure 1C:
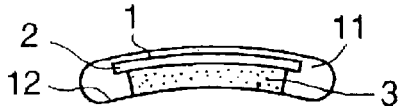
FIG. 1C is a plan view of the cooling apparatus of an internal combustion engine according to the first embodiment of the present invention.
Figure 1D:
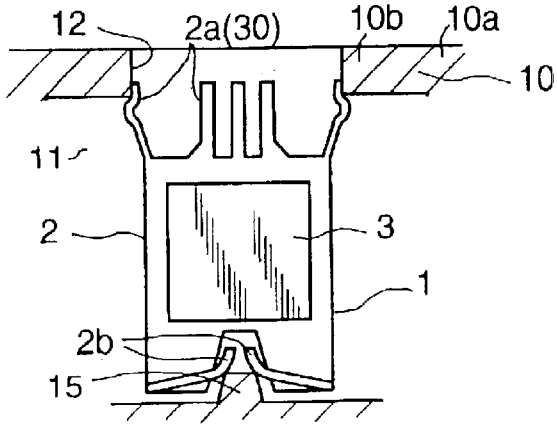
FIG. 1D is a longitudinal cross-sectional view of the cooling apparatus of an internal combustion engine according to the first embodiment of the present invention.

A cooling apparatus of an internal combustion engine according to the present invention will be explained with reference to FIGS. 1A–10B. FIGS. 1–10 illustrate an apparatus according to first—tenth embodiments of the present invention, respectively.

Portions having the same or similar structures over the first through tenth embodiments of the present invention are denoted with the same reference numerals over the first through tenth embodiments of the present invention.

First, the portions having the same or similar structures over the first through tenth of the present invention will be explained with reference to FIGS. 1A–1D.

A cooling apparatus of an internal combustion engine according to the present invention includes a cylinder block 10 and an insert 1. The cylinder block 10 is a closed deck-type cylinder block. The cylinder block 10 has a water jacket 11 continuously extending around cylinder bores 13 and a cylinder bore wall 14. The cylinder block 10 has 10*a* and a plurality of water holes 12 formed in the upper deck 10*a*. The upper deck 10*a* includes a water hole portion 10*b* surrounding the water hole 12. The water holes 12 are formed discontinuous in the extending direction of the water jacket 11. The water hole 12 is a hole through which engine cooling water flows from the water jacket 11 of the cylinder block 10 to a water jacket of a cylinder head. The water hole 12 communicates with the water jacket 11.

The insert 1 is disposed in the water jacket 11 and is inserted through the water hole 12 into the water jacket 11. The cylinder bore wall 14 has a portion downwardly distanced from a combustion chamber, which should be prevented from being over-cooled. The insert 1 is disposed close to that portion to be prevented from over-cooling, of the cylinder bore wall 14 such that the insert 1 contacts or is slightly spaced from an outer surface of that portion. The insert 1 minimizes the flow and amount of the cooling water between the insert 1 and that portion of the cylinder bore wall 14 so that that portion of the cylinder wall 14 is not over-cooled.

When the insert 1 is inserted into the water jacket 11 through the water hole 12, a transverse cross section of the insert 1 has to be smaller than a size of the water hole 12, while after the insert 1 has been inserted in the water jacket 11, the insert 1 preferably expands to be larger in size. Due to the deformation, a clearance between the insert 1 and the cylinder bore wall 14 is decreased, or the insert 1 is brought into contact with the cylinder bore wall 14. As a result, the cooling water is prevented from flowing much between the insert 1 and the cylinder bore wall 14, so that the cylinder bore wall 14 is prevented from being over-cooled.

If the insert 1 is moved and dislocated from a normal position (a position where the insert 1 contacts or is close to the cylinder bore wall 14) when receiving a flow pressure from the cooling water, the effect of preventing the cylinder bore wall 14 from being over-cooled will be decreased and in some cases the water hole 12 may be blocked. Therefore, the insert 1 should be fixed in position relative to the cylinder block 10 by a proper fixing or support structure so that the insert 1 is stably held to the normal position.

The fixing and supporting structure 30 can take various structures according to respective embodiments of the present invention.

Next, structures unique to each embodiment of the present invention and the effects thereof will be explained below.

In the first embodiment of the present invention, as illustrated in FIG. 1, the insert 1 includes a support 2 and an elastic member 3 fixed to the support 2. The elastic member 3 has a feature of expanding in size after the insert 1 has been inserted in the water jacket 11, so that a surface of the elastic member 3 opposing the cylinder bore wall 14 contacts or moves close to the cylinder bore wall 14. The elastic member 3 may be constructed of, for example, a rubber foam which contains a binder and is compressed, so that the rubber foam has a feature of expanding when it contacts water (or LLC, long life coolant). When the water jacket is filled with water or LLC at the stage of engine assembly or vehicle assembly, the size A (smaller than the size of the water hole) at the stage of insertion of the insert 1 changes to the size B (greater than the size of the water hole) at the stage after expansion of the elastic member 3. FIGS. 1B and 1C show that the elastic member 3 contacts the cylinder bore wall 14.

The insert 1 is demountably supported by the cylinder block 10 via the support 2 due to the elasticity of an upper arm 2*a* and a lower arm 2*b*. More particularly, the support 2 is fixed relative to the water hole portion 10*b* surrounding the water hole 12 due to the structure that the upper arm 2*a* elastically contacts the water hole portion 10*b*, and is fixed relative to a protrusion 15 formed in the bottom wall of the water jacket due to the structure that the lower arm 2*b* elastically contacts the protrusion 15. By this structure, the insert 1 is fixed in position even when a flow pressure acts on the insert 1 from the cooling water. The insert 1 is held by the water hole portion 10*b* and the protrusion 15 so as not to be dislocated from the normal position. The upper arm 2*a* and the lower arm 2*b* of the support 2 constructs the fixing and supporting structure 30 of the first embodiment of the present invention.

With an effect of the first embodiment of the present invention, since the upper arm 2*a* and the lower arm 2*b* of the support 2 have an elasticity, the upper arm 2*a* and the lower arm 2*b* of the support 2 can be elastically deformed and shrunk, so that the upper arm 2*a* and the lower arm 2*b* do not become an obstacle to the insertion of the insert 1. Therefore, the insert 1 can be fixed relative to the cylinder block 10, maintaining the mounting feature (insertion feature) of the insert 1 good.

Figure 2A:
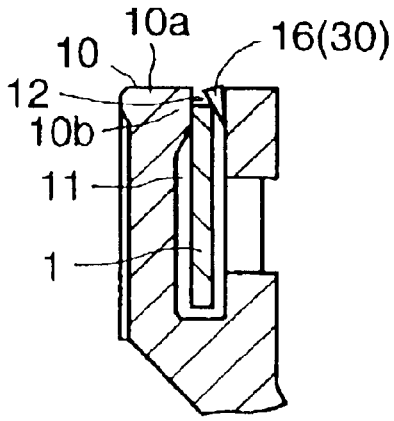
FIG. 2A is a cross-sectional view of a cooling apparatus using a wedge of an internal combustion engine according to a second embodiment of the present invention.
Figure 2B:
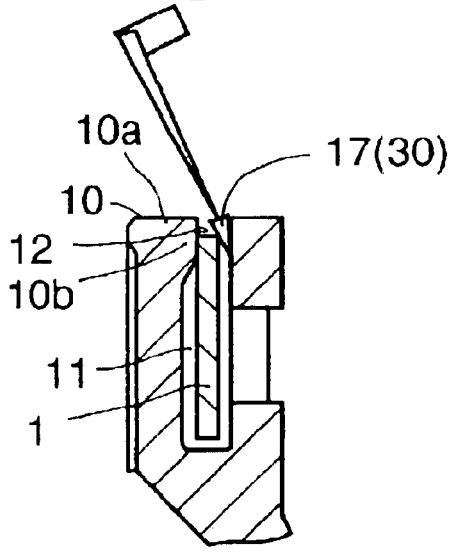
FIG. 2B is a cross-sectional view of a cooling apparatus using a rubber of an internal combustion engine according to the second embodiment of the present invention.

In the second embodiment of the present invention, the insert 1 is fixed relative to the cylinder block 10 so as not to be moved in the flow direction of the cooling water, by inserting a wedge 16 into a clearance between the insert 1 and the water hole portion 10*b* as illustrated in FIG. 2A, or by poring and solidifying a rubber 17 into a clearance between the insert 1 and the water hole portion 10*b* as illustrated in FIG. 2B. The insert 1 may not be supported or may be supported at the lower end of the insert. If not supported at the lower end, the support of the insert becomes a cantilever support at the upper end. The wedge 16 or the rubber 17 is part of the fixing and supporting structure 30 of the second embodiment of the present invention.

With an effect of the second embodiment of the present invention, since the wedge 16 is inserted or the rubber 17 is pored after the insert 1 has been inserted into the water jacket 11, the wedge 16 and the rubber 17 do not become an obstacle to the insertion of the insert 1. Therefore, the insert 1 can be fixed relative to the cylinder block 10, maintaining the mounting feature (insertion feature) of the insert 1 good.

Figure 3A:
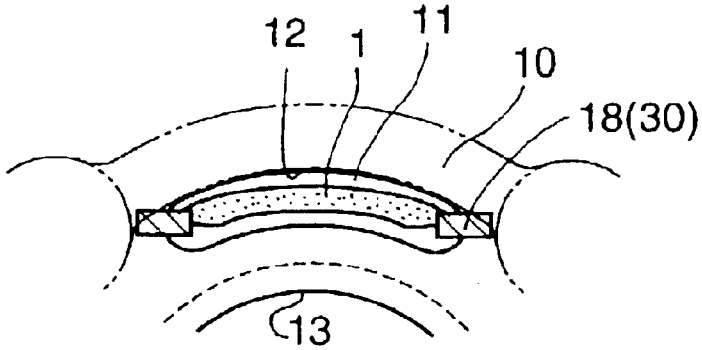
FIG. 3A is a plan view of a cooling apparatus of an internal combustion engine according to a third embodiment of the present invention.
Figure 3B:
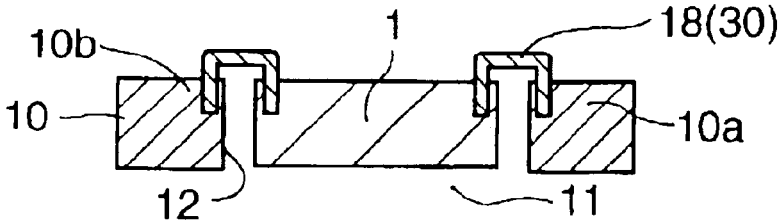
FIG. 3B is a cross-sectional view of the cooling apparatus of an internal combustion engine according to the third embodiment of the present invention.

In the third embodiment of the present invention, as illustrated in FIGS. 3A and 3B, a clip engagement hole is formed in the insert 1 and the water hole portion 10*b* around the water hole 12, and legs of a clip 18 are inserted into the clip engagement hole of the insert 1 and the clip engagement hole of the water hole portion 10*b*, whereby the insert 1 is fixed relative to the cylinder block 10 so as not to be moved in the flow direction of the cooling water. The clip 18 extends over the insert 1 and the water hole portion 10*b*. The insert 1 is fixed relative to the cylinder block 10 at the water hole portion 10*b*. The insert 1 may be or may not be supported at the lower portion of the insert. If not supported at the lower portion, the support becomes a cantilever support at the upper end of the insert. The clip 18 is the fixing and supporting structure 30 of the third embodiment of the present invention.

With an effect of the third embodiment of the present invention, since the insert 1 is fixed by the clip 18 after the insert 1 has been inserted into the water jacket 11, the clip 18 does not become an obstacle to the insertion of the insert 1. Therefore, the insert 1 can be fixed relative to the cylinder block 10, maintaining the mounting feature (insertion feature) of the insert 1 good.

Figure 4A:
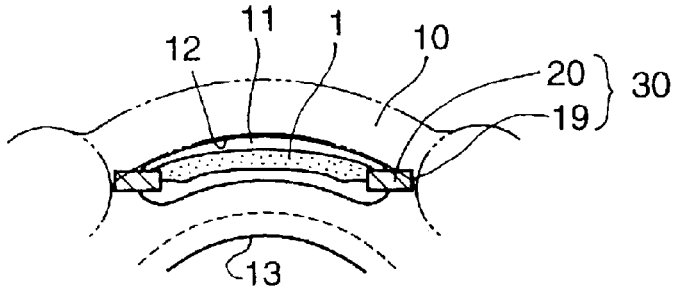
FIG. 4A is a plan view of a cooling apparatus of an internal combustion engine according to a fourth embodiment of the present invention.
Figure 4B:
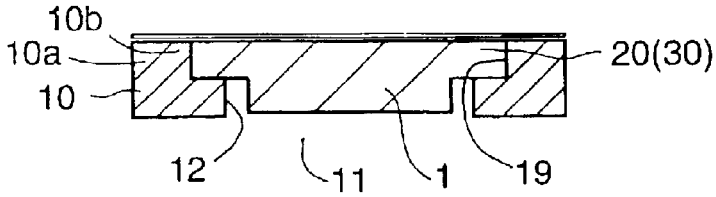
FIG. 4B is a cross-sectional view of the cooling apparatus of an internal combustion engine according to the fourth embodiment of the present invention.

In the fourth embodiment of the present invention, as illustrated in FIGS. 4A and 4B, a groove 19 is formed in the water hole portion 10*b* around the water hole 12, and a key 20 fitted into the groove 19 is formed in the insert 1. The key 20 is fitted into the groove 19 after the insert 1 has been inserted into the water jacket 11, whereby the insert 1 is fixed relative to the cylinder block 10 so as not to be moved in the flow direction of the cooling water. The insert 1 is fixed relative to the cylinder block 10 at the water hole portion 10*b*. The insert 1 may be or may not be supported at the lower portion of the insert. If not supported at the lower portion, the support becomes a cantilever support at the upper end of the insert. The key 20 and the groove 19 are the fixing and supporting structure 30 of the fourth embodiment of the present invention.

With an effect of the fourth embodiment of the present invention, since the insert 1 is fixed by the key 20 and groove 19 after the insert 1 has been inserted into the water jacket 11, the key 20 and groove 19 do not become an obstacle to the insertion of the insert 1. Therefore, the insert 1 can be fixed relative to the cylinder block 10, maintaining the mounting feature (insertion feature) of the insert 1 good.

Figure 5A:
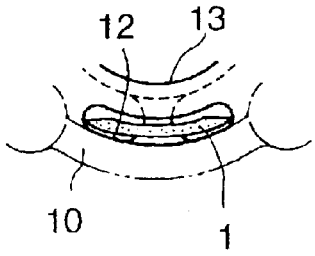
FIG. 5A is a plan view of a cooling apparatus of an internal combustion engine according to a fifth embodiment of the present invention.
Figure 5B:
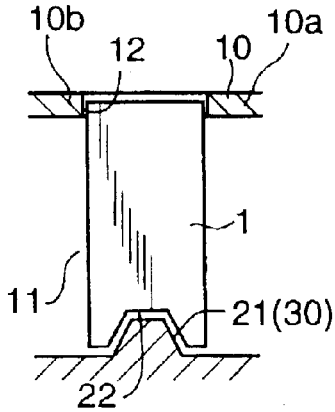
FIG. 5B is a cross-sectional view of the cooling apparatus of an internal combustion engine according to the fifth embodiment of the present invention.
Figure 5C:
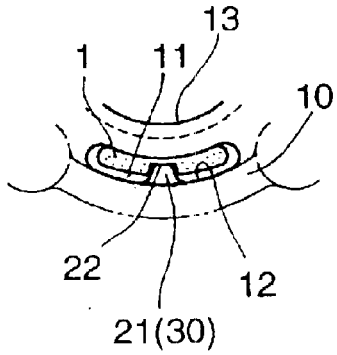
FIG. 5C is a plan view of a cooling apparatus of an internal combustion engine according to a variation of the fifth embodiment of the present invention.

In the fifth embodiment of the present invention, as illustrated in FIGS. 5A, 5B and 5C, the cylinder block 10 has a water jacket wall surrounding the water jacket 11, and a stopper (as the fixing and supporting structure 30) for preventing the insert 1 from moving downstream in a flow direction of the cooling water is formed to the water jacket wall.

The stopper is a protrusion 21 formed in at least one of a bottom wall portion and an outer side wall portion of the water jacket wall. In FIGS. 5A and 5B, the protrusion 21 is formed in the bottom surface of the water jacket 11. In FIG. 5C, the protrusion 21 is formed in the outer side surface of the water jacket 11. In the insert 1, at a portion corresponding to the protrusion 21, a concave groove 22 is formed. The protrusion 21 enters and engages the groove 22. The protrusion 21 is the stopper (as the fixing and supporting structure 30) of the fifth embodiment of the present invention.

With an effect of the fifth embodiment of the present invention, since the protrusion 21 enters and engages the groove 22, the insert 1 is not dislocated from the normal position when the insert 1 receives a flow pressure from the cooling water. Since the protrusion 21 is formed at the bottom surface or the outer side surface of the water jacket 11, the protrusion 21 does not become an obstacle to the insertion of the insert 1. Therefore, the insert 1 can be fixed relative to the cylinder block 10, maintaining the mounting feature (insertion feature) of the insert 1 good.

Figure 6:
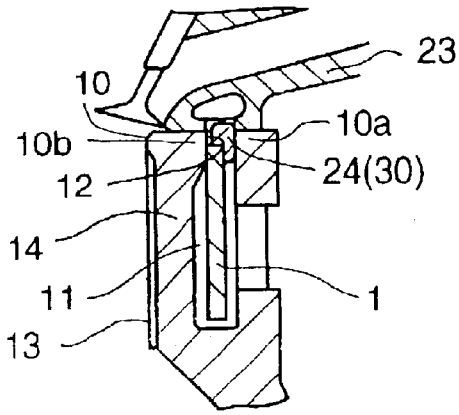
FIG. 6 is a cross-sectional view of a cooling apparatus of an internal combustion engine according to a sixth embodiment of the present invention.

In the sixth embodiment of the present invention, as illustrated in FIG. 6, the stopper (as the fixing and supporting structure 30) is an extension 24 extending from a cylinder head 23 mounted to the cylinder block 10 into the water jacket 11. The extension 24 supports the insert 1 from the downstream side of the insert 1 and prevents the insert 1 from being dislocated in the flow direction of the cooling water. The extension 24 may support and fix the upper portion of the insert 1 in a thickness direction of the insert as illustrated in FIG. 6. The extension 24 may be a member separately manufactured from the cylinder head 23 and coupled to the cylinder head, and may support and fix the upper portion of the insert 1 when the cylinder head 23 is mounted to the cylinder block 10.

With an effect of the sixth embodiment of the present invention, since the extension 24 supports the insert 1 from the downstream side of the insert 1, the insert 1 is prevented from being dislocated from the normal position in the flow direction of the cooling water when the insert 1 receives a flow pressure from the cooling water. Since the cylinder head 23 is mounted onto the cylinder block 10 after the insert 1 has been inserted into the water jacket 11, the extension 24 does not become an obstacle to the insertion of the insert 1. Therefore, the insert 1 can be fixed relative to the cylinder block 10, maintaining the mounting feature (insertion feature) of the insert 1 good.

Figure 7A:
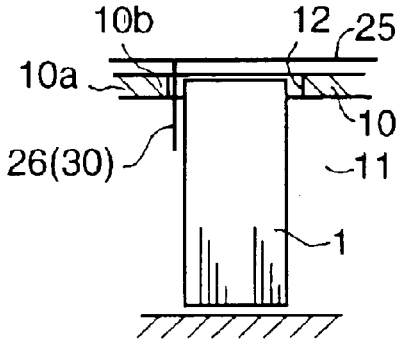
FIG. 7A is a cross-sectional view of a cooling apparatus of an internal combustion engine according to a seventh embodiment of the present invention.
Figure 7B:
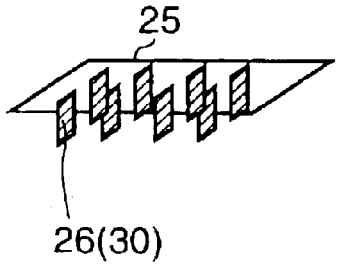
FIG. 7B is a perspective view of a stopper portion of the cooling apparatus of a internal combustion engine according to the seventh embodiment of the present invention.

In the seventh embodiment of the present invention, as illustrated in FIGS. 7A and 7B, the stopper (as the fixing and supporting structure 30) is an extension 26 extending from a cylinder head gasket 25 mounted to the cylinder block 10 into the water jacket 11. The extension 26 supports the insert 1 from the downstream side of the insert 1 and prevents insert 1 from being dislocated in the flow direction of the cooling water.

With an effect of the seventh embodiment of the present invention, since the extension 26 supports the insert 1 from the downstream side of the insert 1, the insert 1 is prevented from being dislocated from the normal position in the flow direction of the cooling water when the insert 1 receives a flow pressure from the cooling water. Since the cylinder head gasket 25 is mounted onto the cylinder block 10 after the insert 1 has been inserted into the water jacket 11, the extension 26 does not become an obstacle to the insertion of the insert 1. Therefore, the insert 1 can be fixed relative to the cylinder block 10, maintaining the mounting feature (insertion feature) of the insert 1 good.

Figure 8A:
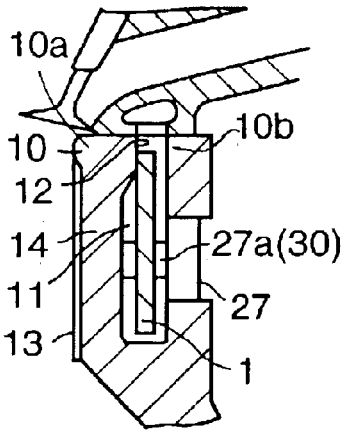
FIG. 8A is a transverse cross-sectional view of a cooling apparatus of an internal combustion engine according to an eighth embodiment of the present invention.
Figure 8B:
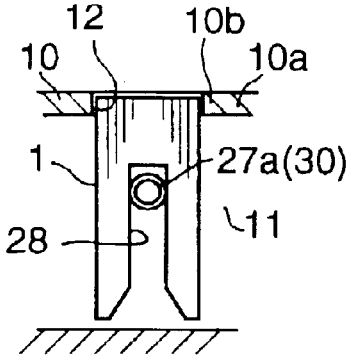
FIG. 8B is a longitudinal cross-sectional view of the cooling apparatus of an internal combustion engine according to the eighth embodiment of the present invention.
Figure 8C:
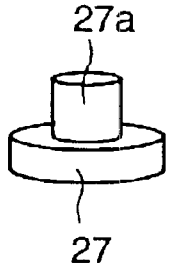
FIG. 8C is a perspective view of a tight plug of the cooling apparatus of an internal combustion engine according to the eighth embodiment of the present invention.

In the eighth embodiment of the present invention, as illustrated in FIGS. 8A, 8B and 8C, the stopper (as the fixing and supporting structure 30) is a protrusion 27*a* protruding from a tight plug 27 into the water jacket 11. The insert 1 has a groove 28 or slit for receiving the protrusion 27*a* therein. The groove 28 opens downwardly, so that when the insert 1 is inserted into the water jacket 11 from above, the protrusion 27*a* of the tight plug 27 can enter the groove 28 of the insert 1. The protrusion 27*a* engages the groove 28 laterally and prevents the insert 1 from being dislocated in the flow direction of the cooling water.

With an effect of the eighth embodiment of the present invention, since the protrusion 27*a* extends from the tight plug 27 into the water jacket 11 and engages the groove 28 of the insert 1, the insert 1 is prevented from being dislocated from the normal position in the flow direction of the cooling water when the insert 1 receives a flow pressure from the cooling water. Since the groove 28 opens downwardly, the protrusion 27*a* does not become an obstacle to the insertion of the insert 1. Therefore, the insert 1 can be fixed relative to the cylinder block 10, maintaining the mounting feature (insertion feature) of the insert 1 good.

Figure 9A:
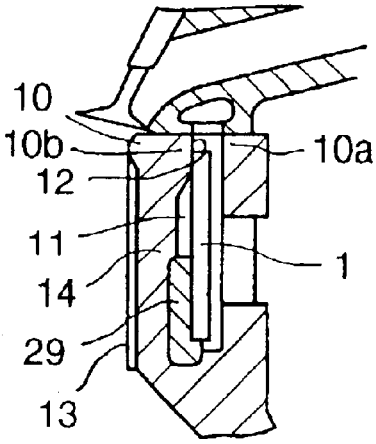
FIG. 9A is a transverse cross-sectional view of a cooling apparatus of an internal combustion engine according to a ninth embodiment of the present invention.
Figure 9B:
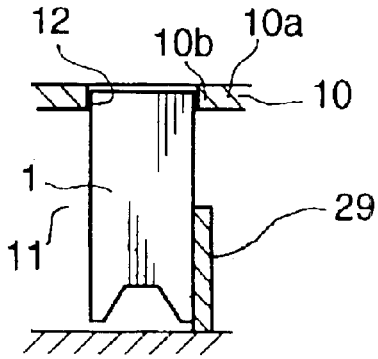
FIG. 9B is a longitudinal cross-sectional view of the cooling apparatus of an internal combustion engine according to the ninth embodiment of the present invention.

In the ninth embodiment of the present invention, as illustrated in FIGS. 9A and 9B the stopper (as the fixing and supporting structure 30) is a chaplet 29 of a sand core used in casting of the cylinder block 10 and remaining in the water jacket 11. The chaplet 29 supports the insert 1 from the downstream side of the insert 1 and prevents the insert 1 from being dislocated in the flow direction of the cooling water.

With an effect of the ninth embodiment of the present invention, since the chaplet 29 supports the insert 1 from the downstream side of the insert 1, the insert 1 is prevented from being dislocated from the normal position in the flow direction of the cooling water when the insert 1 receives a flow pressure from the cooling water. Since the chaplet 29 is not located in the insertion direction of the insert 1, the chaplet 29 does not become an obstacle to the insertion of the insert 1. Therefore, the insert 1 can be fixed relative to the cylinder block 10, maintaining the mounting feature (insertion feature) of the insert 1 good.

Figure 10A:
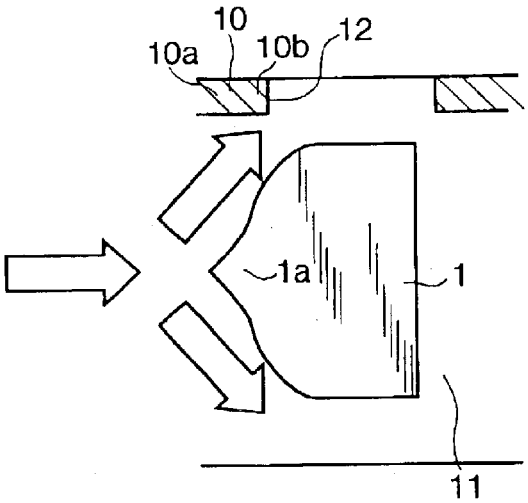
FIG. 10A is a longitudinal cross-sectional view of a cooling apparatus of an internal combustion engine according to a tenth embodiment of the present invention.
Figure 10B:
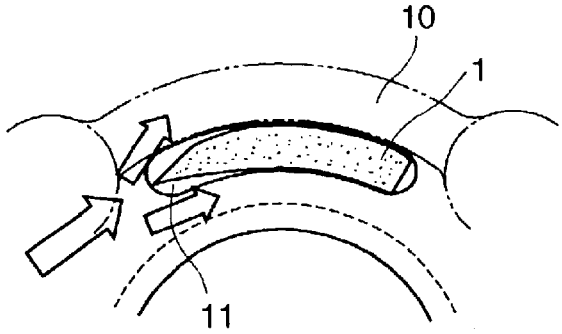
FIG. 10B is a plan view of the cooling apparatus of an internal combustion engine according to the tenth embodiment of the present invention.

In the tenth embodiment of the present invention, as illustrated in FIGS. 10A and 10B, the insert 1 includes an upstream portion having a streamline configuration 1*a*. The streamline configuration 1*a* decreases a force of the flow of the cooling water acting on the insert 1 and prevents the insert 1 from being dislocated in the flow direction A of the cooling water. Further, the streamline configuration 1*a* is formed symmetric in a vertical direction with respect to a vertical central portion of the insert 1, so that the force acting on the insert 1 is balanced in the vertical direction. Furthermore, the upstream portion of the insert 1 has a tapered configuration narrowed in an upstream direction, so that the insert 1 receives a minimum force from the flow of the cooling water.

With an effect of the tenth embodiment of the present invention, since the insert 1 is formed to a streamline configuration, the insert 1 does not receive a large force from the flow of the cooling water so that the insert 1 is unlikely to be moved in the flow direction of the cooling water. By constructing the portion having the streamline configuration 1*a* from a material that expands when it contacts water, the portion having the streamline configuration 1*a* is not an obstacle to the insertion of the insert 1. Therefore, the insert 1 can be fixed relative to the cylinder block 10, maintaining the mounting feature (insertion feature) of the insert 1 good.

The following technical advantages are obtained by the invention.

According to the apparatus of any of the first through fourth embodiments of the present invention, since the insert 1 is fixed relative to the cylinder block 10 at the water hole portion 10*b*, the insert 1 is effectively prevented from being dislocated from its normal position when receiving a pressure from the cooling water, while feasibility of mounting the insert 1 into the water jacket 11 is maintained. In particular, in the apparatus according to the second and third embodiments of the present invention, a particular machining does not need to be performed on the cylinder block 10. Further, in the apparatus according to the second embodiment of the present invention, a particular step for fixing the insert 1 does not need to be added.

According to the apparatus of any of the fifth through ninth embodiments of the present invention, since the insert 1 contacts a stopper formed to the water jacket wall, the insert 1 is prevented from being dislocated from its normal position when receiving a pressure from the cooling water, while feasibility of mounting the insert 1 into the water jacket 11 is maintained.

According to the apparatus according to the tenth embodiment of the present invention, since the insert 1 has an upstream portion having a streamline configuration 1*a*, the pressure acting on the insert 1 from the cooling water is minimized. As a result, the insert 1 is prevented from being dislocated from its normal position.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A cooling apparatus of an internal combustion engine comprising:

a closed deck-type cylinder block having a water jacket for allowing engine cooling water to flow therein to cool the engine, and an upper deck including a water hole formed therein for causing the cooling water to flow therethrough and a water hole portion surrounding the water hole; and an insert disposed in the water jacket and inserted into the water jacket through the water hole, wherein the insert is fixed relative to the cylinder block at the water hole portion such that the insert is fixed in position in a flow direction of the cooling water, and the insert includes a spring mechanism formed therein for fixing the insert to the cylinder block by a reaction force of the spring mechanism.

2. An apparatus according to claim 1, further comprising a pad provided in a clearance between the water hole portion and the insert, for fixing the insert to the cylinder block.

3. An apparatus according to claim 1, further comprising a clip engaging with the water hole portion and the insert so as to fix the insert to the cylinder block.

4. An apparatus according to claim 1, wherein the cylinder block includes a groove formed in the water hole portion of the upper deck and the insert has a key formed therein and fitted in the groove so as to fix the insert to the cylinder block.

5. A cooling apparatus of an internal combustion engine comprising:

a closed deck-type cylinder block having a water jacket for allowing engine cooling water to flow therein to cool the engine and a water jacket wall surrounding the water jacket, and an upper deck including a water hole formed therein for causing the cooling water to flow therethrough; and an insert disposed in the water jacket and inserted into the water jacket through the water hole, wherein a stopper for preventing the insert from moving downstream in a flow direction of the cooling water is provided, and the insert engages the stopper such that the insert is fixed in position in the flow direction of the cooling water, and the stopper is a protrusion formed in at least one of a bottom wall portion and an outer side wall portion of the water jacket wall.

6. A cooling apparatus of an internal combustion engine comprising:

a closed deck-type cylinder block having a water jacket for allowing engine cooling water to flow therein to cool the engine, and an upper deck including a water hole formed therein for causing the cooling water to flow therethrough; and an insert inserted into the water jacket through the water hole, wherein the insert includes an upstream portion having a streamline configuration, the streamline configuration being formed symmetric in a vertical direction with respect to a vertical central portion of the insert.

7. An insert for use in a closed deck-type cylinder block having a water jacket for allowing engine cooling water to flow therein to cool an engine, and an upper deck including a water hole formed therein for causing the cooling water to flow therethrough, the insert being inserted into the water jacket through the water hole, the insert comprising:

an upstream portion having a streamline configuration, the streamline configuration being formed symmetric in a vertical direction with respect to a vertical central portion of the insert.

* * * * *